US005557379A

United States Patent [19]

Nakamura et al.

[11] Patent Number: 5,557,379

[45] Date of Patent: Sep. 17, 1996

[54] IMAGE FORMING APPARATUS HAVING A TONER CONVEYANCE REGULATOR

[75] Inventors: Tetsuya Nakamura; Hirotaka Fukuyama, both of Tokyo, Japan

[73] Assignee: Kabushiki Kaisha Toshiba, Kanagawa-ken, Japan

[21] Appl. No.: 205,541

[22] Filed: Mar. 4, 1994

[30] Foreign Application Priority Data

Mar. 5, 1993 [JP] Japan ..... 5-044905
Apr. 30, 1993 [JP] Japan ..... 5-103974

[51] Int. Cl.[6] ..... G03G 15/08

[52] U.S. Cl. ..... 355/259; 355/253; 118/688

[58] Field of Search ..... 355/246, 259, 355/253, 245; 118/689, 691, 693, 688

[56] References Cited

U.S. PATENT DOCUMENTS 4,084,899 4/1978 Ishida et al. .
4,398,817 8/1983 Nishimura ..... 118/657 X
4,947,473 8/1990 Kinashi ..... 355/259
4,970,557 11/1990 Masuda ..... 355/246
5,005,517 4/1991 Fukui et al. ..... 118/689
5,287,151 2/1994 Sugiyama ..... 355/260

*Primary Examiner*—R. L. Moses
*Attorney, Agent, or Firm*—Finnegan, Henderson, Farabow, Garrett & Dunner, L.L.P.

[57] ABSTRACT

A developing device for use in an image forming apparatus comprising a toner hopper containing toner, a developing roller for developing an electrophotographic latent image formed on a surface of a photosensitive member using the toner contained in the toner hopper, a toner feed mechanism for conveying the toner contained in the toner hopper to the developing roller, and a regulator for regulating the conveyance of the toner by the feed mechanism from the toner hopper to the developing roller.

20 Claims, 13 Drawing Sheets

| COMPARISON RESULT | REVOLUTION SPEED OF FEED ROLLER |
|---|---|
| T2/T1 ≦ FIRST CRITERION | NORMAL LEVEL |
| FIRST CRITERION < T2/T1 ≦ SECOND CRITERION | FIRST LEVEL |
| SECOND CRITERION < T2/T1 | SECOND LEVEL |

FIG. 7 (b)
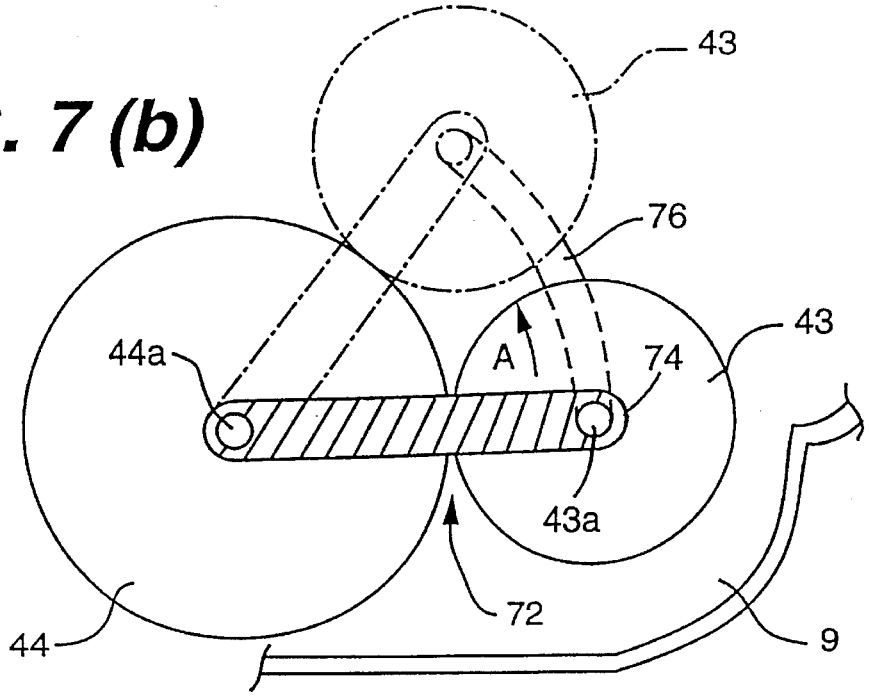
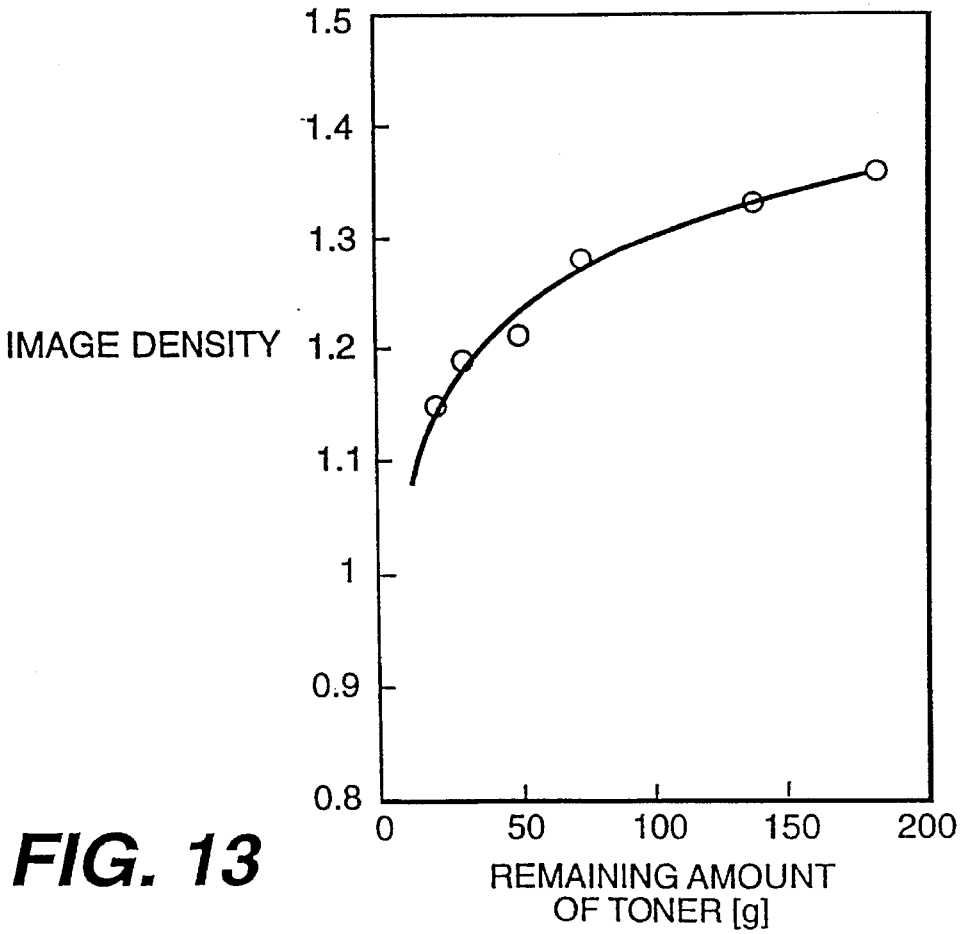
FIG. 13

IMAGE FORMING APPARATUS HAVING A TONER CONVEYANCE REGULATOR

BACKGROUND OF THE INVENTION

1. Field of the Invention

The present invention relates to a developing device for use in an image forming apparatus such as a facsimile or copying apparatus, and more particularly to a developing device for performing an electrophotographic process in such an image forming apparatus.

2. Description of the Related Art

FIG. 12 shows the structure of an image forming apparatus including a conventional developing device. As shown in FIG. 12, a photosensitive drum 1 having an outer photosensitive surface is rotated in a clockwise direction by a rotary drive mechanism (not shown). As also shown in FIG. 12, a charging device 2, an exposure device 3, a developing device 4, a transfer device 6, and a cleaning device 8 are arranged about the outer surface of the photosensitive drum 1. The photosensitive drum 1, the charging device 2, the developing device 4, and the cleaning device 8 are integrally supported by a side cover 9 to form a process unit 100.

The developing device 4 comprises a toner hopper 41, a toner pack 42, a feed roller 43, a developing roller 44, a developing blade 45, a support rod 46, a leaf spring 47, a support 48, a reinforcing plate 49, a toner sensor 50, and an agitator 51.

The toner hopper 41 is a hollow container having an upper open portion for storing toner therein. The toner pack 42 is mounted on the upper open portion of the toner hopper 41. The toner pack 42 is filled with toner and its opening is sealed with a seal sheet (not shown). When the seal sheet is removed and the toner pack 42 is mounted on the toner hopper 41, the toner from the toner pack 42 empties into the toner hopper 41. The toner sensor 50 is provided at a bottom portion of the toner hopper to detect the presence of toner.

The feed roller 43 is arranged at an opening on a side surface of the toner hopper 41 such that it is partly located in the toner hopper 41. The feed roller 43 is driven by a motor (not shown). The developing roller 44 lightly contacts both the photosensitive drum 1 and the feed roller 43. The feed roller 43 and the developing roller 44 are rotated in a counterclockwise direction by a rotary drive mechanism (not shown). The feed roller 43 carries the toner stored in the toner hopper 41 and supplies it to the developing roller 44. The developing roller 44 carries the toner provided by the feed roller 43 and supplies it to the outer surface of the photosensitive drum 1.

The cylindrical support rod 46 is arranged parallel to and above the developing roller 44 to support the developing blade 45 in contact with the developing roller 44. The leaf spring 47 is fixed to the support 48 and urges the support rod 46 toward the developing roller 44 with a set force and thereby urges the developing blade 45 against the developing roller 44. The support 48 is fixed to the side wall of the toner hopper 41.

In the facsimile apparatus having the structure as described above, an image is printed in the following manner.

First, the charging device 2 charges the outer photosensitive surface of the photosensitive drum 1 to a predetermined potential (e.g., −600 V). Subsequently, the exposure device 3 exposes the charged photosensitive surface of the photosensitive drum 1 in accordance with an image to be printed, thereby forming an electrostatic latent image on the surface of the photosensitive drum 1. Then, the developing device 4 develops the electrostatic latent image formed on the photosensitive surface of the photosensitive drum 1, as follows.

The agitator 51 rotates and carries the toner in the toner hopper 41 to the feed roller 43. The feed roller 43 is supplied with a predetermined voltage more negative than that of the developing roller 44. As a result, the feed roller 43 carries the toner, which tends to be negatively charged, to the developing roller 44 and the developing roller 44 carries and conveys the toner to the photosensitive drum 1. In particular, when the developing roller 44 rotates, toner carried on the developing roller 44 receives friction between the developing roller 44 and the developing blade 45. As a result, the toner is charged by this friction. A urethane resin layer is provided on the surface of the developing roller 44 and is positively charged by friction with the toner. Further, the developing blade 45 is made of silicone which is positively charged by the friction with the toner. Accordingly, the toner is negatively charged due to the polarization of the resin layer of the developing roller 44, and the polarization of the developing blade 45.

A developing bias, for example −200 V, having the same polarity as that of the potential of the photosensitive drum 1, is applied to the developing roller 44. The toner selectively attaches to the photosensitive drum 1 due to the presence of the electric fields of the electrostatic latent image, the developing bias, and the toner charge. The toner does not attach to the non-exposed portions of the photosensitive drum 1 since the potential at those portions of the photosensitive drum 1 are more negative than that of the developing roller 44. The toner attaches to the exposed portions of the photosensitive drum 1, however, since the potential at those portions of the photosensitive drum 1 are less negative than that of the developing roller 44. In this manner, a toner image corresponding to the electrostatic latent image is formed on the surface of the photosensitive drum 1. This toner image is transferred to a printing sheet (not shown) by a positive voltage of the transfer device 6.

After the printing sheet is separated from the photosensitive surface of the photosensitive drum 1, toner which is not transferred to the sheet and which remains on the surface of the photosensitive drum 1 is removed by the cleaning device 8.

In the image forming apparatus of FIG. 12, toner feeding parameters, such as revolution speed of the feed roller 43, revolution speed of the agitator 51, the voltage difference between the feed roller 43 and the developing roller 44, are held constant. Further, as the toner in toner hopper 41 is consumed, the densities of images formed on sheets of paper change. FIG. 13 shows changes in image density in accordance with the remaining amount of the toner in the toner hopper 41. As shown in FIG. 13, as the amount of toner remaining in the toner hopper 41 decreases, image density also decreases. Thus, if the toner feeding parameters are set so that image density is appropriate when there is a lot of toner remaining in the toner hopper 41, image density is poor when there is little remaining toner in the toner hopper 41. As a result, it becomes difficult for the user of the apparatus to see the developed image formed on the paper when toner levels are low and the user must operate a key unit of the image forming apparatus in order to increase image density. Similarly, if the toner feeding parameters are set so that image density is appropriate when there is little toner left in the toner hopper 41, the image density is too great when there is a lot of toner in the toner hopper 41, e.g., when a new toner pack 42 is attached to the toner hopper. As a result, the user must operate the key unit of the image forming apparatus to decrease image density.

Further, as described above, the toner receives friction between the developing blade 45 and the developing roller 44. As a result, the toner is charged. However, as the amount of the toner in the toner hopper 41 is great, the weight of the toner is likewise great. When the toner with its own great weight is conveyed to the developing blade 45 by the feed roller 43 and the developing roller 44, the toner presses the developing blade 45 toward the photosensitive drum 1. Accordingly, the pressure of the developing blade 45 against the developing roller 44 decreases in this state. As a result, some of the toner tends to pass between the developing blade 45 and the developing roller 44. Therefore, some of the toner does not receive enough friction between the blade 45 and the roller 44. Accordingly, some of the toner is not sufficiently charged. This insufficiently charged toner is conveyed to a contact portion between the developing roller 44 and the photosensitive drum 1 and the roller 44 presses the toner to the drum 1. In this case, if the toner is not sufficiently charged, the electrostatic repulsive force acting on the insufficiently charged toner particles in a non-image portion of the latent image is smaller than the adhesive force which causes the toner particles to be transferred to the photosensitive drum 1. Therefore, the insufficiently charged toner is adhered not only to an image portion of the photosensitive drum 1 but also to a non-image portion thereof. The condition in which toner is adhered to the non-imaged portion of the photosensitive drum 1 is called fog.

A relationship between the amount of toner inside the toner hopper 41 and the amount of fog on the photosensitive drum is shown in FIG. 14. The degree of fog on the photosensitive drum 1 is expressed in a following manner. A first mending tape is adhered to the photosensitive drum 1 corresponding to the non-image background area. After that, in the event that the first mending tape is removed from the photosensitive drum 1 and adhered to a white paper, a first reflectance is sampled from the first mending tape. A second reflectance is sampled from a second mending tape which is not used and adhered to the white paper. The degree of fog on the photosensitive drum 1 is expressed by a difference between the first reflectance and the second reflectance. As shown in FIG. 14, the greater the amount of toner inside the toner hopper 41, the greater the fog on the photosensitive drum 1. Further, at the transfer device 6, the toner adhered to the non-imaged portion is transferred to the portion of the paper corresponding to the non-imaged portion at the transfer device 6.

FIG. 15 shows a relationship between the number of recorded sheets of paper on which toner has been supplied by the toner hopper 41 and the amount of fog on the photosensitive drum 1. As shown in FIG. 15, the smaller the number of recorded sheets, the greater the fog. Thus, the amount of fog is great immediately after the toner is supplied with the toner hopper 41.

If the feeding parameters are set so that the fog is appropriate when there is a lot of toner remaining in the toner hopper 41, the image density is poor when there is little remaining toner in the toner hopper 41. Similarly, if the toner feeding parameters are set so that the image density is appropriate when there is little toner left in the toner hopper 41, the fog is great when there is a lot of toner in the toner hopper 41.

SUMMARY OF THE INVENTION

Accordingly, the present invention has been made in view of the above circumstances and it is an object of the present invention to provide a developing device which decreases a change of image density of an image recorded on the paper in accordance with the consumption of toner in a toner hopper.

Another object of the present invention is to provide a developing device which decreases fog on a photosensitive drum.

Additional objects and advantages of the invention will be set forth in part in the description which follows and in part will be apparent from the description, or may be learned by practice of the invention. The objects and advantages of the invention may be realized and attained by means of the instrumentalities and combinations particularly pointed out in the written description and claims hereof as well as the appended drawings.

To achieve these and other objects and advantages and in accordance with the purpose of the invention, there is provided a developing device for use in an image forming apparatus, comprising a toner hopper containing toner, a developing roller for developing an electrophotographic latent image formed on a surface of a photosensitive member using the toner contained in the toner hopper, a toner feed mechanism to convey the toner contained in the toner hopper to the developing roller, and regulating means for regulating the conveyance of the toner by the feed mechanism from the toner hopper to the developing roller.

Further, there is provided a developing device for use in an image forming apparatus, comprising a toner hopper containing toner, a developing roller for developing an electrophotographic latent image formed on a surface of a photosensitive member by using the toner contained in the toner hopper, and regulating means for regulating a revolution speed of the developing roller.

It is to be understood that both the foregoing general description and the following detailed description are exemplary and explanatory and are intended to provide further explanation of the invention as claimed.

BRIEF DESCRIPTION OF THE DRAWING

The accompanying drawings, which are incorporated in and constitute a part of this specification, illustrate several embodiments of the invention and, together with the description, serve to explain the objects, advantages, and principles of the invention. In the drawings:

FIG. 7(*b*) is a cross-sectional side view illustrating a transferring mechanism of the fourth embodiment;

FIG. 13 is a chart illustrating a relationship between image density and a remaining amount of toner in the toner hopper;

DESCRIPTION OF THE PREFERRED EMBODIMENTS

Reference will now be made in detail to the present preferred embodiments of the invention, examples of which are illustrated in the accompanying drawings.

Figure 1:
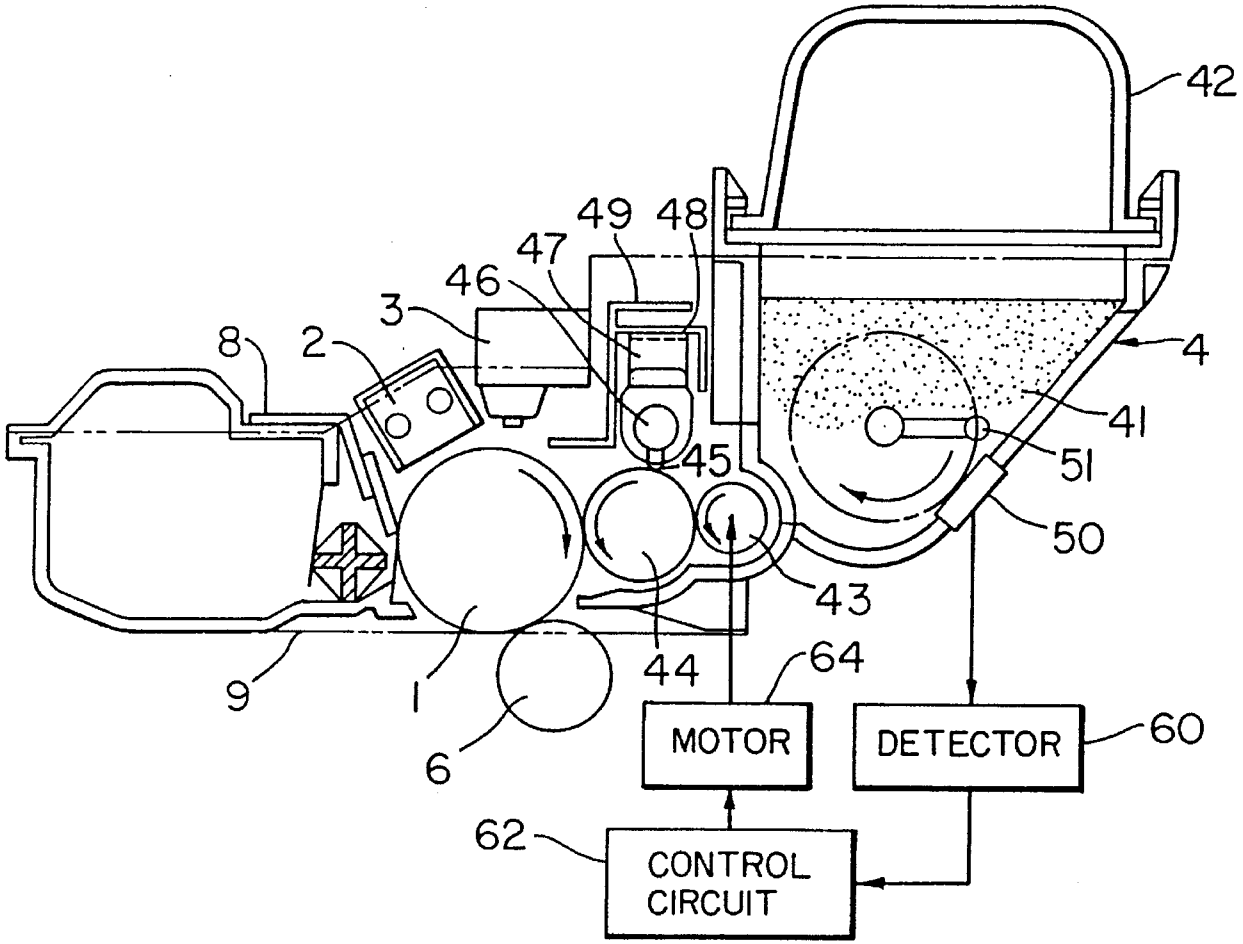
FIG. 1 is a cross-sectional side view illustrating a first embodiment of the present invention.
Figure 12:
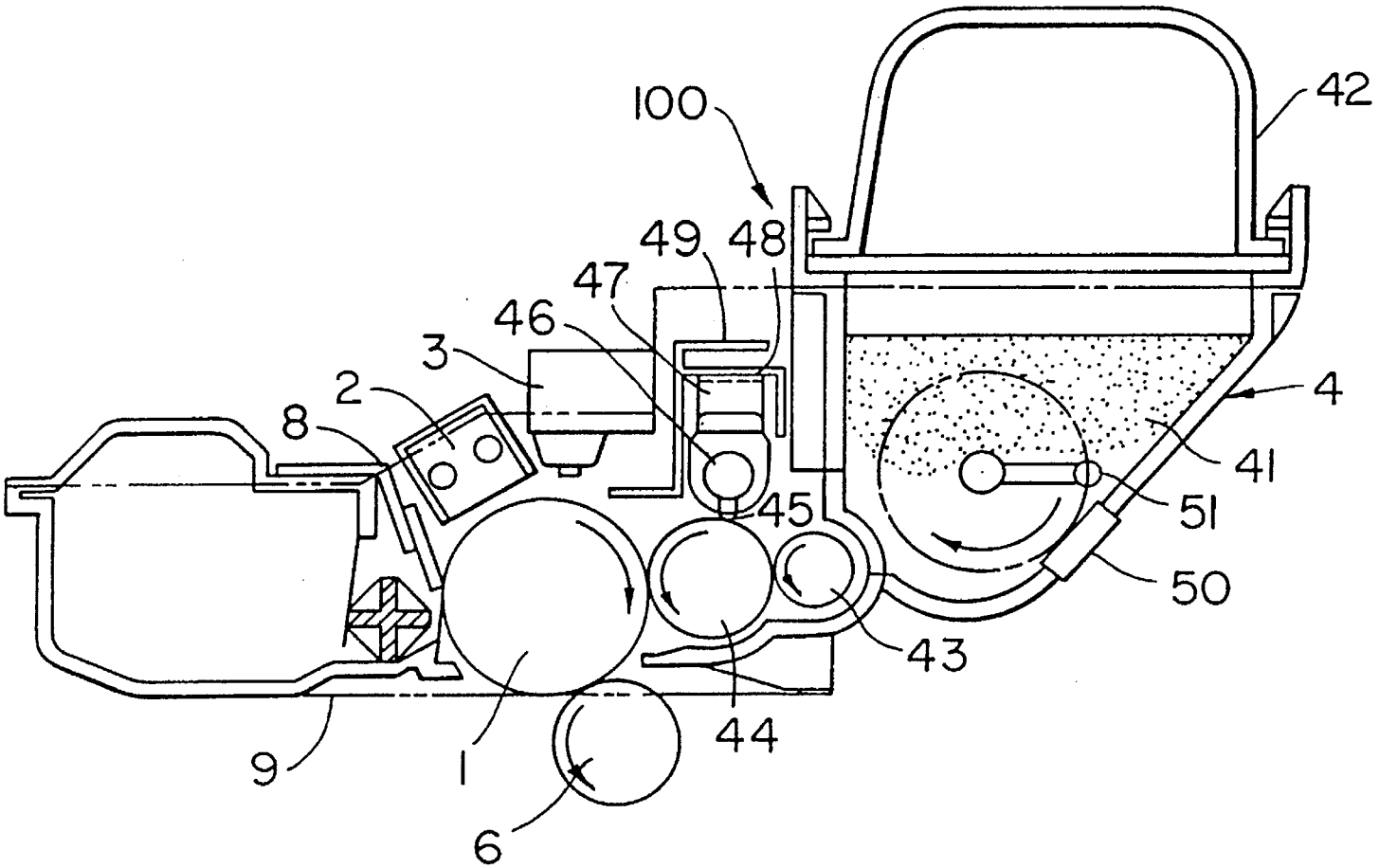
FIG. 12 is a cross-sectional side view illustrating an image forming apparatus including a conventional developing device.
Figure 14:
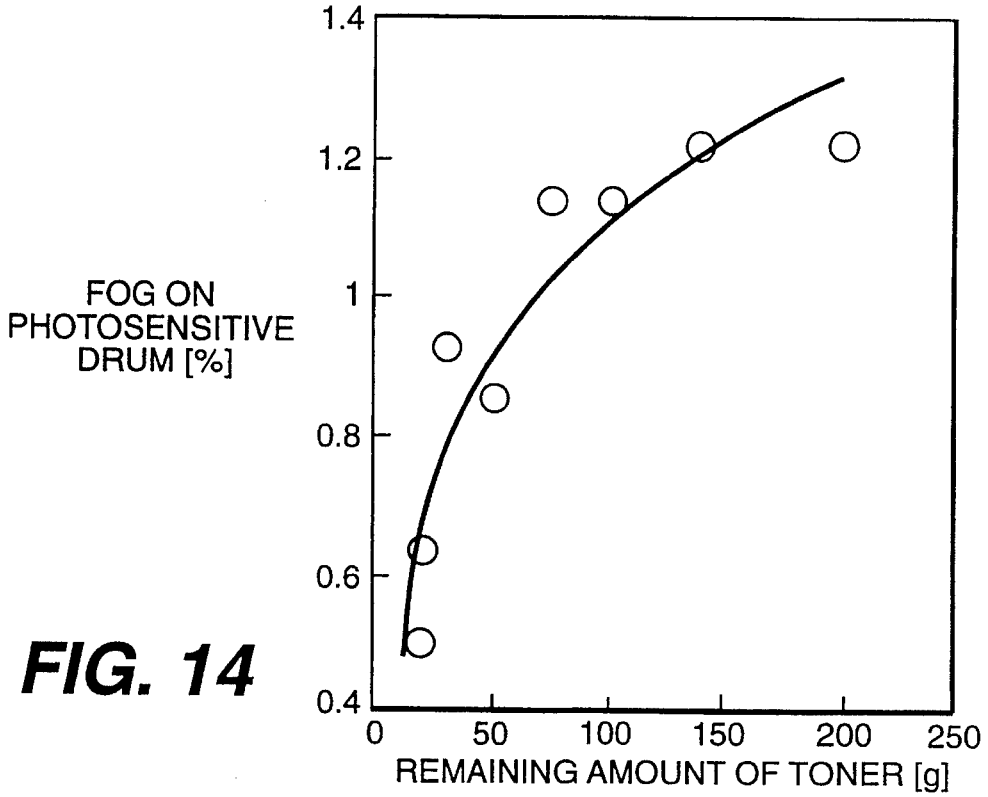
FIG. 14 is a chart illustrating a relationship between the amount of fog on a photosensitive drum and a remaining amount of toner in the toner hopper.

FIG. 1 shows an image forming apparatus according to a first embodiment. Common elements of the first embodiment and the conventional apparatus shown in FIG. 12 have the same reference numerals, and their explanations are omitted.

As shown in FIG. 1, the toner sensor 50 is connected to a detector 60. The toner sensor 50 is a piezoelectric component which converts a pressure on the component to current. If there is toner on the toner sensor 50, the toner sensor 50 outputs a first predetermined voltage signal to the detector 60. Otherwise, the toner sensor 50 outputs a second predetermined voltage signal to the detector 60. In this case, the first predetermined voltage is 5 V and the second predetermined voltage is 0 V.

Figure 2:
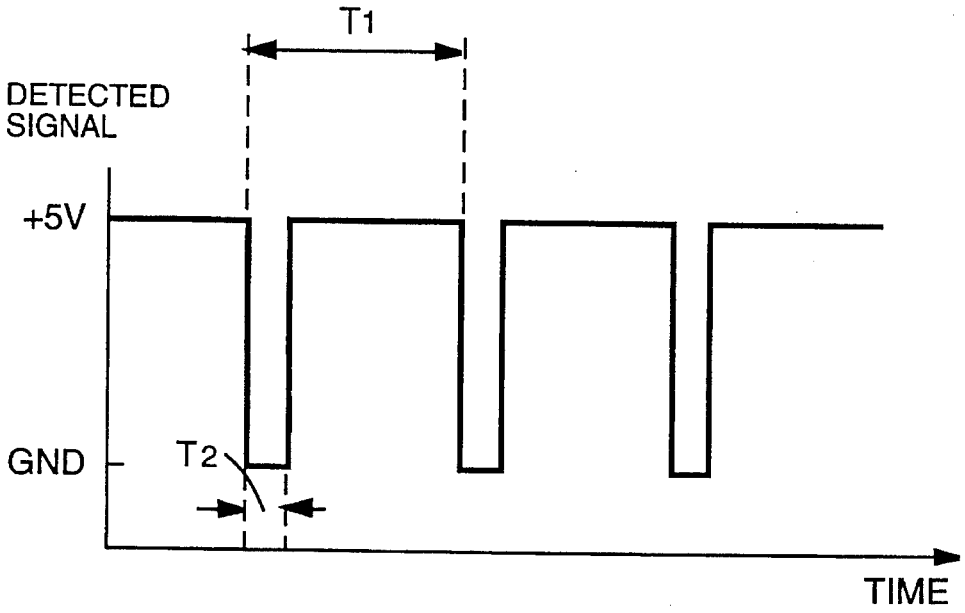
FIG. 2 is a chart illustrating a relationship between a detected signal from a toner sensor provided in a toner hopper and time.

The detector 60 detects a period during which the detector 60 receives the second predetermined voltage (0 V) signal. As shown in FIG. 2, the period is referred to as T2. The period during which the agitator 51 rotates once is referred as T1. The detector 60 calculates a value of T2/T1. The value of T2/T1 increase as the toner in the toner hopper 41 decreases. Thus, the value of T2/T1 is proportional to the remaining amount of toner in the toner hopper 41.

Figure 3:
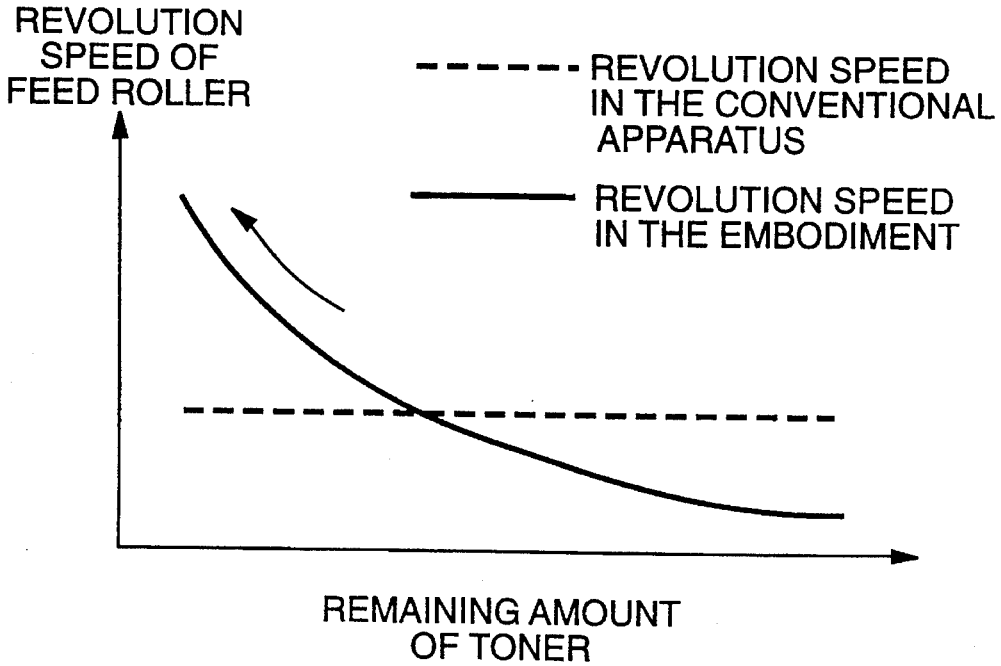
FIG. 3 is a chart illustrating a relationship between revolution speed of a feed roller and remaining amount of toner in a toner hopper.

As shown in FIG. 1, the detector 60 outputs a signal indicative of the value of T2/T1 to a control circuit 62. The control circuit 62 controls the revolution speed of a motor 64 driving the feed roller 43 in response to the signal from the detector 60. As shown in FIG. 3, the control circuit 62 increases the revolution speed of the feed roller 43 as the amount of toner in the toner hopper 41 decreases.

According to the first embodiment, when the remaining amount of toner becomes small, and therefore the ability of the feed roller 43 to feed the toner to the developing roller 44 becomes small, the control circuit 62 increases the revolution speed of the feed roller 43. Therefore, the control circuit 62 compensates for the lowering of the toner feeding ability of the feed roller 43 when the remaining amount of the toner becomes small. As a result, image density when the remaining amount of the toner is small, is almost the same as image density when the remaining amount of the toner is great.

As also shown in FIG. 3, when the remaining amount of the toner in the toner hopper 41 is great, the control circuit 62 decreases the revolution speed of the feed roller 43, compared to that in a case which the remaining amount of the toner is small. Therefore, when the remaining amount of the toner is great, the apparatus prevents excessive toner from being supplied with the developing roller 44 and the developing blade 45. As a result, the amount of fog on the photosensitive drum 1 decreases when the remaining amount of the toner is great.

Figures 4, 5:
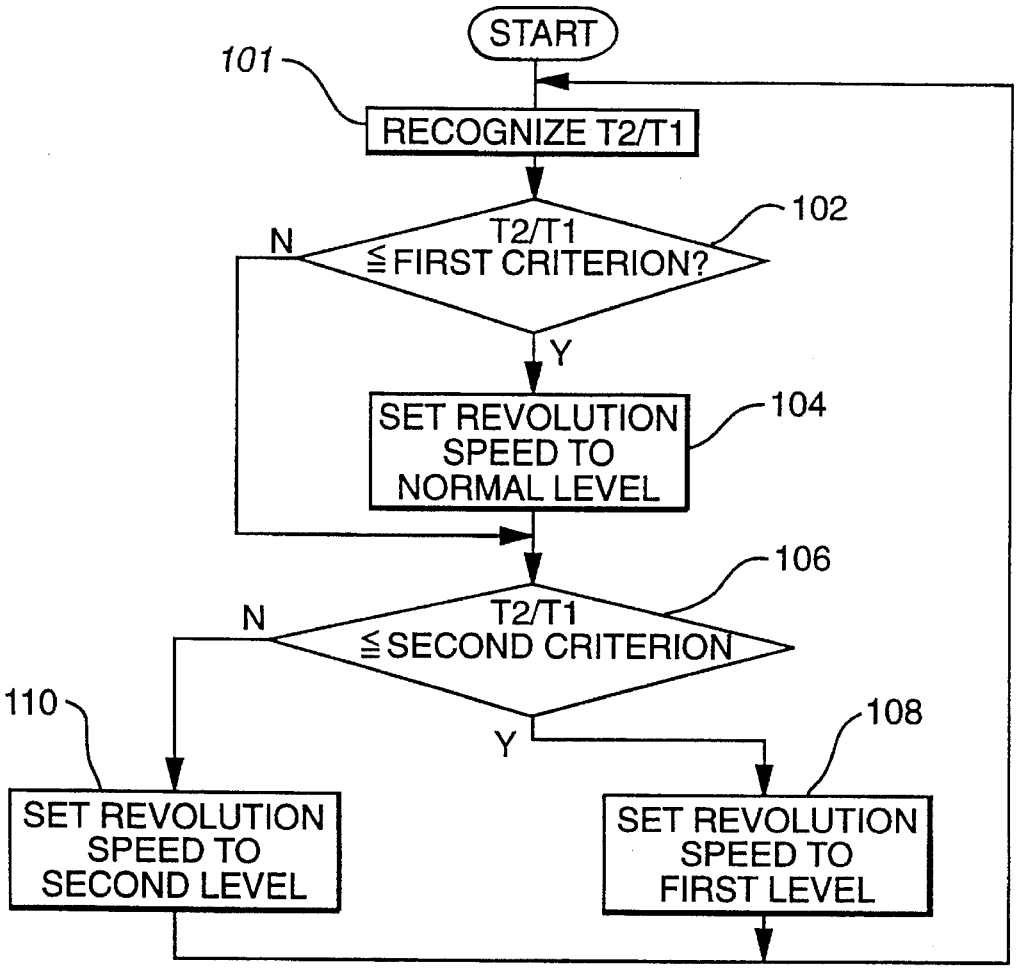
FIG. 4 is a flow chart illustrating operation of a second embodiment of the present invention for determining the revolution speed of the feed roller.
FIG. 5 is a table for determining a revolution speed of the feed roller.

FIG. 4 shows a second embodiment. The second embodiment is different from the first embodiment with respect to the way of setting the revolution speed of the feed roller 43. The control circuit 62 recognizes the value of T2/T1 during which there is no toner on the toner sensor 50 (step 101). Thereafter, the control circuit 62 compares the value of T2/T1 to a first criterion (step 102). If the value of T2/T1 is at or below the first criterion, the control circuit 62 sets the revolution speed of the feed roller 43 to a normal level (step 104). If the value of T2/T1 is above the first criterion, or after step 104, the control circuit 62 compares the value of T2/T1 to a second criterion which is larger than the first criterion (step 106).

If the value of T2/T1 is at or below the second criterion, the control circuit 62 sets the revolution speed of the feed roller 43 to a first level which is larger than the normal level (step 108). Otherwise, the control circuit 62 sets the revolution speed of the feed roller 43 to a second level which is larger than the first level (step 110).

FIG. 5 shows the setting of the revolution speed of the feeding roller 43 in response to the value of T2/T1 according to the second embodiment.

Figure 6:
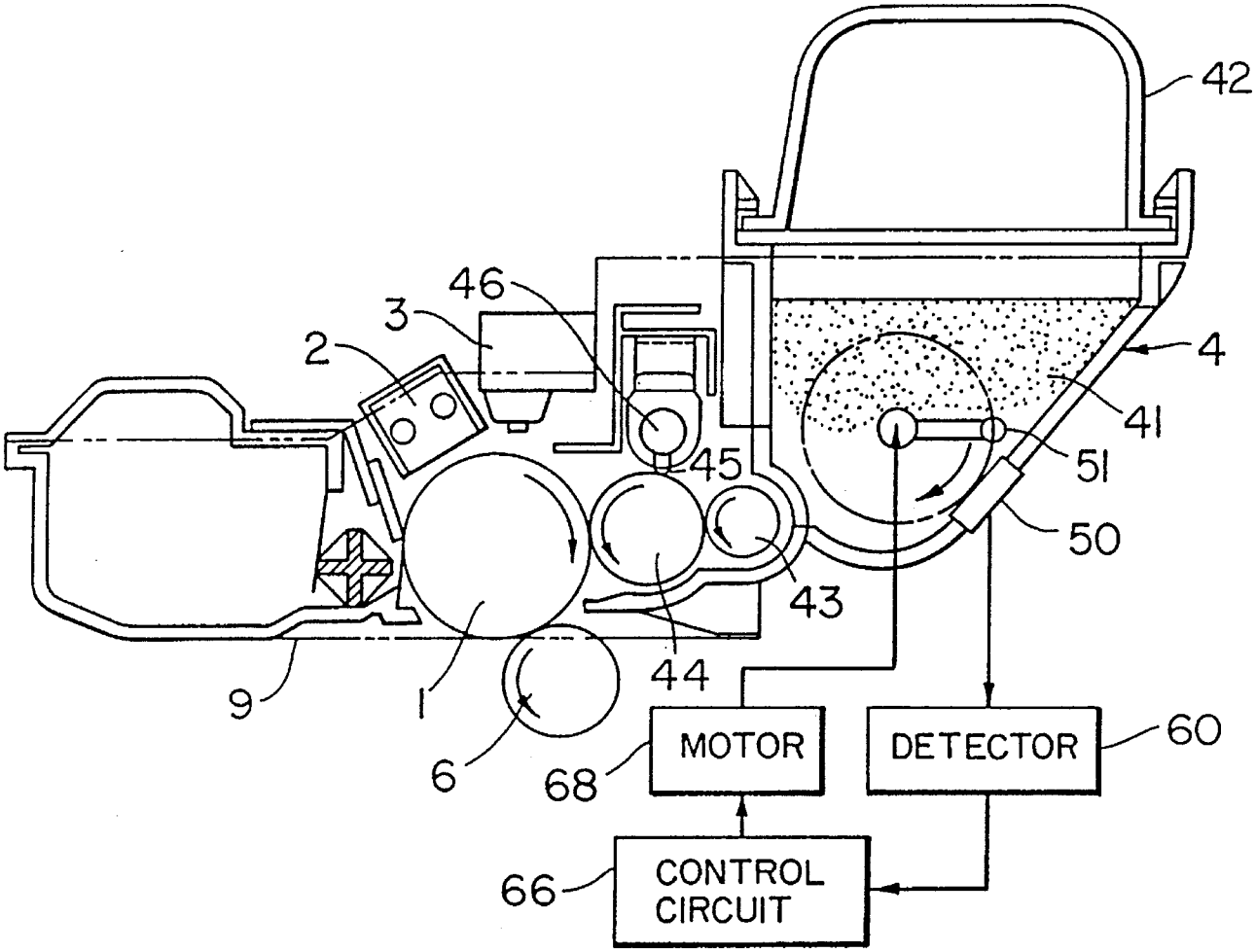
FIG. 6 is a cross-sectional side view illustrating a third embodiment of the present invention.

FIG. 6 shows a third embodiment. In the third embodiment, the agitator 51 is controlled in response to the remaining amount of toner in the toner hopper 41. Common elements of the third embodiment and the first embodiment shown in FIG. 1 have the same reference numerals, and their explanations are omitted.

In response to the output signal from the detector 60 indicative of the value of T2/T1, a control circuit 66 controls the revolution speed of a motor 68 for driving the agitator 51. As the value of T2/T1 becomes small, that is, as the remaining amount of toner in toner hopper 41 becomes small, the control circuit 66 increases the revolution speed of the agitator 51. As a result, the third embodiment compensates for the lowering of the toner feeding ability by increasing the revolution speed of the agitator 51 when the remaining amount of toner becomes small.

Figure 7A:
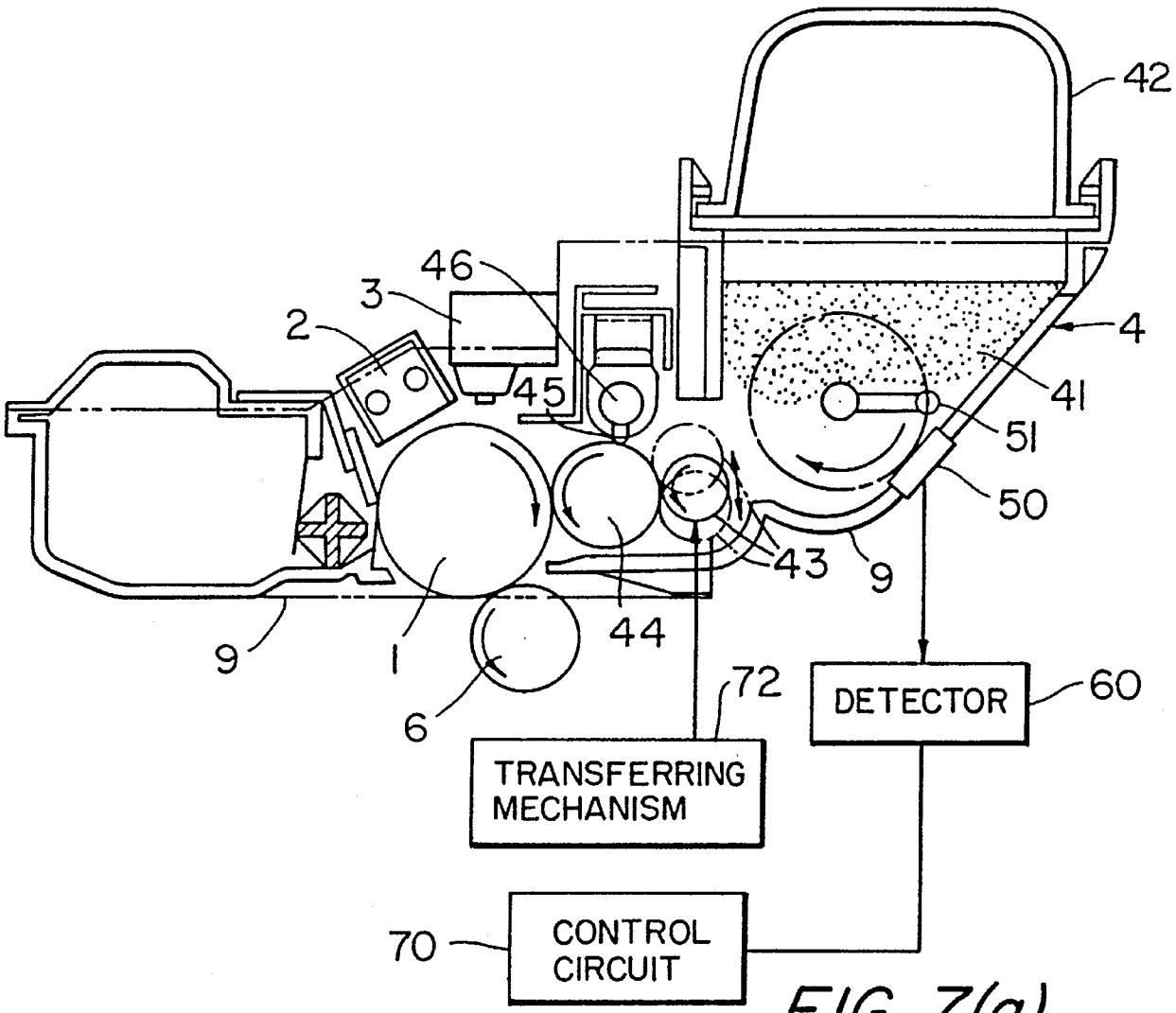
FIG. 7(*a*) is a cross-sectional side view illustrating a fourth embodiment of the present invention.

FIG. 7(*a*) shows a fourth embodiment. In the fourth embodiment, the location of the feed roller 43 is controlled in response to the remaining amount of toner in the toner hopper 41. Common elements of the fourth embodiment and the first embodiment shown in FIG. 1 have the same reference numerals, and their explanations are omitted.

In response to the output signal from the detector 60 indicative of the value of T2/T1, the control circuit 62 controls a transferring mechanism 72 for transferring the feed roller 43. In particular, the transferring mechanism 72 controls the location of the feed roller 43 while maintaining the feed roller 43 in contact with the developing roller 44. FIG. 7(*b*) shows the transferring mechanism 72 in detail. As shown in FIG. 7(*b*), a support material 74 supports a feed roller shaft 43*a*. The support material 74 is rotated around a developing roller shaft 44*a* in a direction A by a rotary mechanism (not shown) in response to consumption of toner in the toner hopper 41 under the control of the control circuit 70. A groove 76 is provided at an area of the side cover 9 of the process unit 4 corresponding to the trail of movement of the feed roller shaft 43*a*.

As shown in FIG. 7(*a*), there is provided a contact portion between the feed roller 43 and the developing roller 44. The feed roller 43 feeds the toner in the toner hopper 41 to the contact portion of the developing roller 44. Further, the developing roller 44 feeds the toner to the developing blade 45. In this case, the toner is charged by friction between the developing roller 44 and the developing blade 45. The smaller the distance between the contact portion and the developing blade 45, the greater the amount of conveyed toner.

As the remaining amount of toner corresponding to the value of T2/T1 becomes small, the control circuit 70 draws the feed roller 43 to the position near the developing blade 45. Therefore, as the remaining amount of toner becomes small and the toner feeding ability becomes small, the control circuit 70 increases the amount of toner conveyed to the developing blade 45 by drawing the feed roller 43 to the position near the developing blade 45. As a result, the fourth embodiment also compensates for the lowering of the toner feeding ability.

Although the control circuit 70 has been described to draw the feed roller 43 toward the developing blade 45, the control circuit 70 can alternatively draw the developing blade 45 toward the feed roller 43 to decrease the distance between the developing blade 45 and the feed roller 43.

Figure 8:
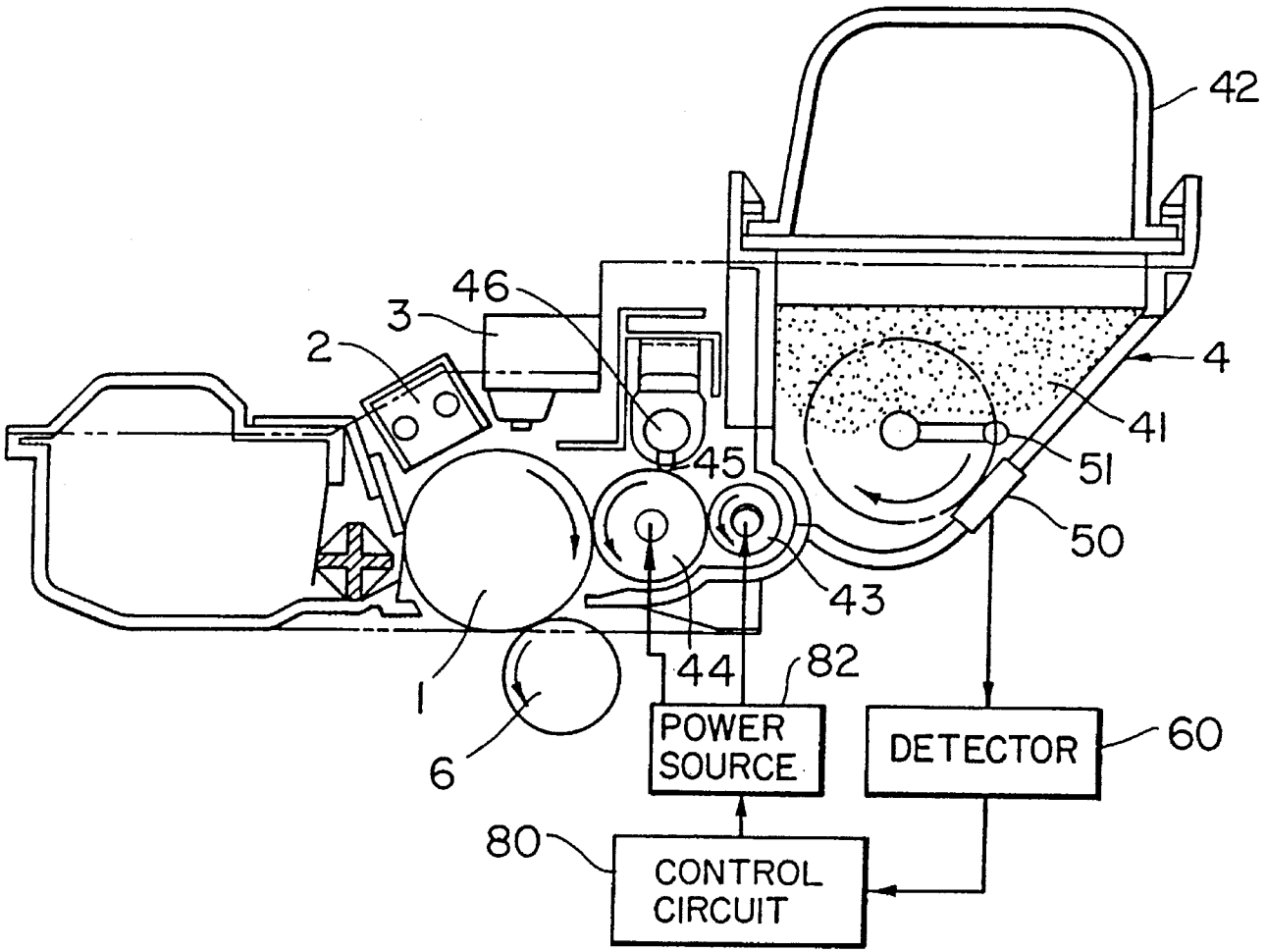
FIG. 8 is a cross-sectional side view illustrating a fifth embodiment of the present invention.

FIG. 8 shows a fifth embodiment. In the fifth embodiment, the voltage of the feed roller 43 is controlled in response to the consumption of the toner. Referring to FIG. 8, a control circuit 80 is connected to the detector 60 and a power source 82. The output voltage of the power source 82 varies in accordance with an output signal from the control circuit 80 which is indicative of the value of T2/T1.

The toner includes a material which has a tendency to be negatively charged. The urethane resin layer which tends to be charged with a positive polarity is provided on the surface of the feed roller 43. Therefore, the toner is charged with a negative polarity due to the polarization effect caused by the urethane resin layer being charged with a positive polarity. In a normal state, the potential of the feed roller 43 is −300 V while the potential of the developing roller 44 is −200 V. Therefore, the potential of the feed roller 43 is more negative than that of the developing roller 44. As a result, the toner on the feed roller 43 is fed to the developing roller 44 which is less negatively charged than the feeder roller 43.

In the fifth embodiment, as the amount of remaining toner in the toner hopper 41 becomes small, the control circuit 80 controls the power source 82 so that the voltage of the feed roller 43 becomes negatively greater than −300 V. As a result, the voltage difference between the feed roller 43 and the developing roller 44 increases thereby improving the toner feeding ability of feeding toner from the feed roller 43 to the developing roller 44.

Although in the fifth amendment, the control circuit 80 controls the voltage of the feed roller 43, the control circuit 80 may also control the voltage of the developing roller 44 so that the voltage of the developing roller 44 becomes negatively smaller when the remaining amount of toner becomes small.

Although, in the above embodiments, the control circuit regulates the conveyance of the toner by the feed roller 43 from the toner hopper 41 to the developing roller 44 in response to the amount of the toner contained in the toner hopper 41, the control circuit may also regulate the conveyance of toner in response to a user's instruction.

Figure 9:
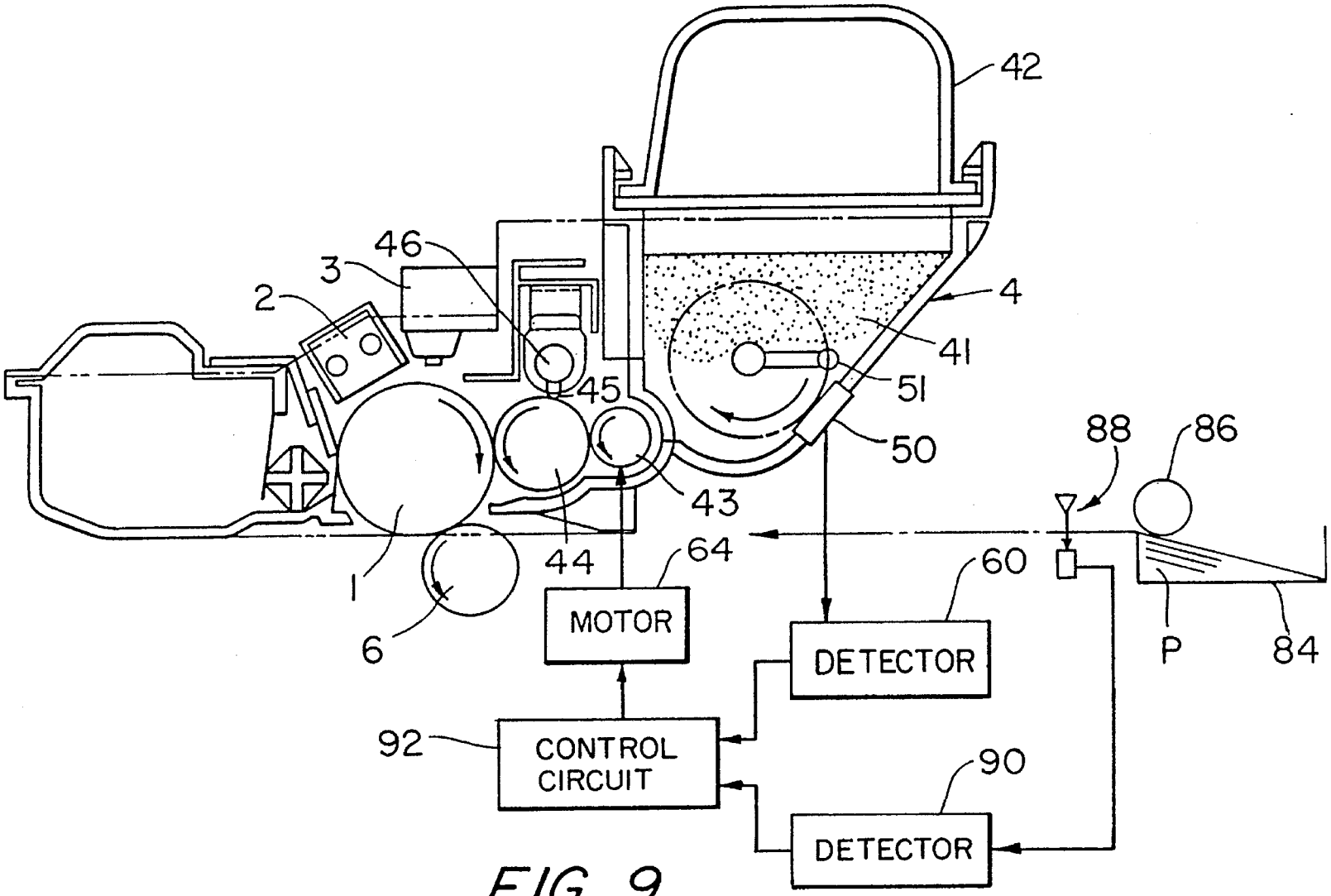
FIG. 9 is a cross-sectional side view illustrating a sixth embodiment of the present invention.

FIG. 9 shows a sixth embodiment. In the sixth embodiment, the revolution speed of the feed roller 43 is controlled in response to the number of recorded sheets of paper.

As shown in FIG. 9, a paper cassette 84 contains sheets of paper. A feed roller 86 is provided near the paper cassette 84 for feeding sheets of paper to a paper guide mechanism including a paper path. A sensor 88 is provided along the paper path, for detecting the passage of a sheet of paper. If the passage of a sheet of paper is detected, the sensor 88 outputs an output signal to a detector 90. When the detector 90 receives the output signal from the sensor 88, the detector 90 increases a value N corresponding to a number of recorded sheets of paper. The detector 90 is connected to a control circuit 92. The detector 60 and the detector 90 are connected to the control circuit 92.

Figure 10:
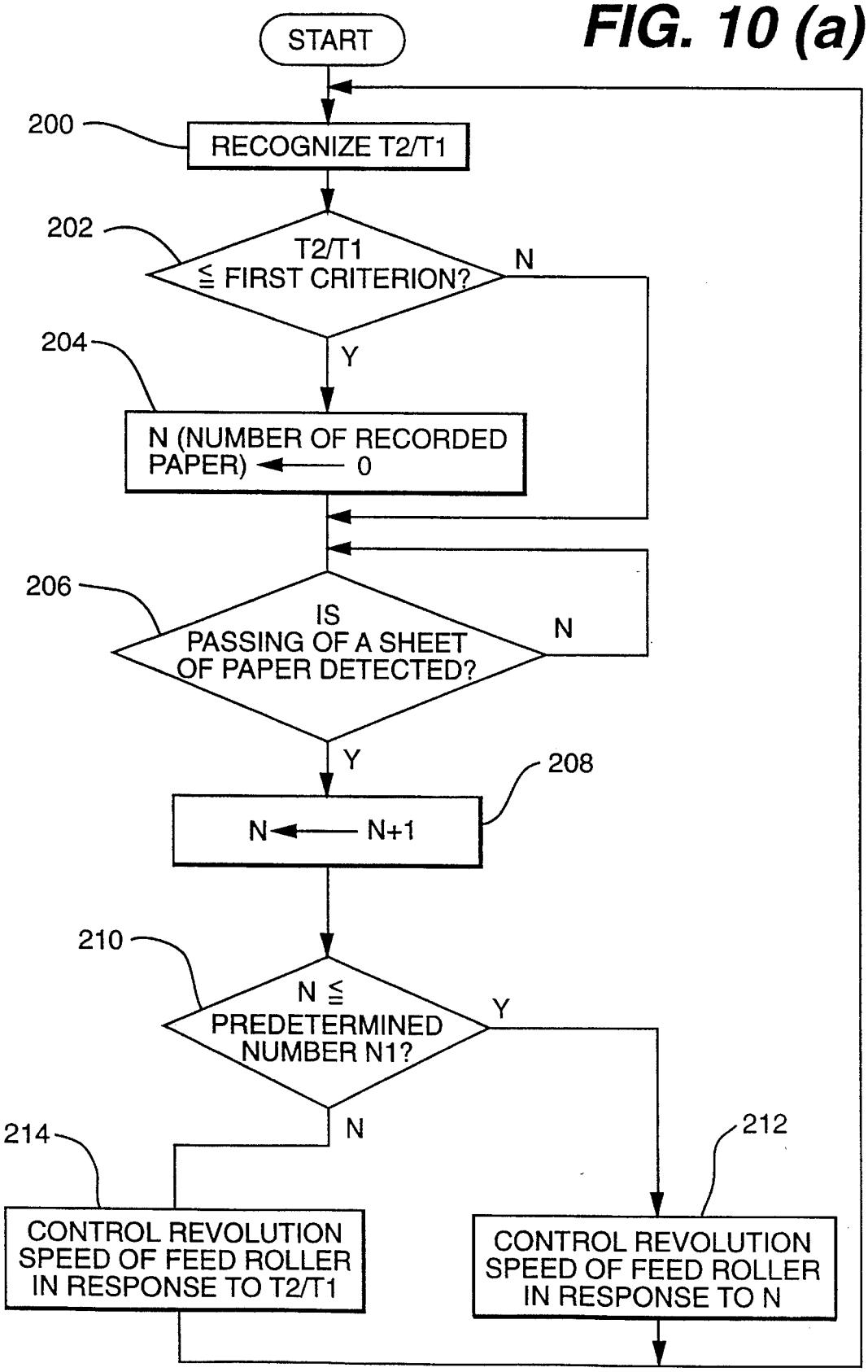
FIGS. 10(*a*) and 10(*b*) are flow charts illustrating operations of the sixth embodiment of the present invention for determining the revolution speed of the feed roller.
Figure 10:
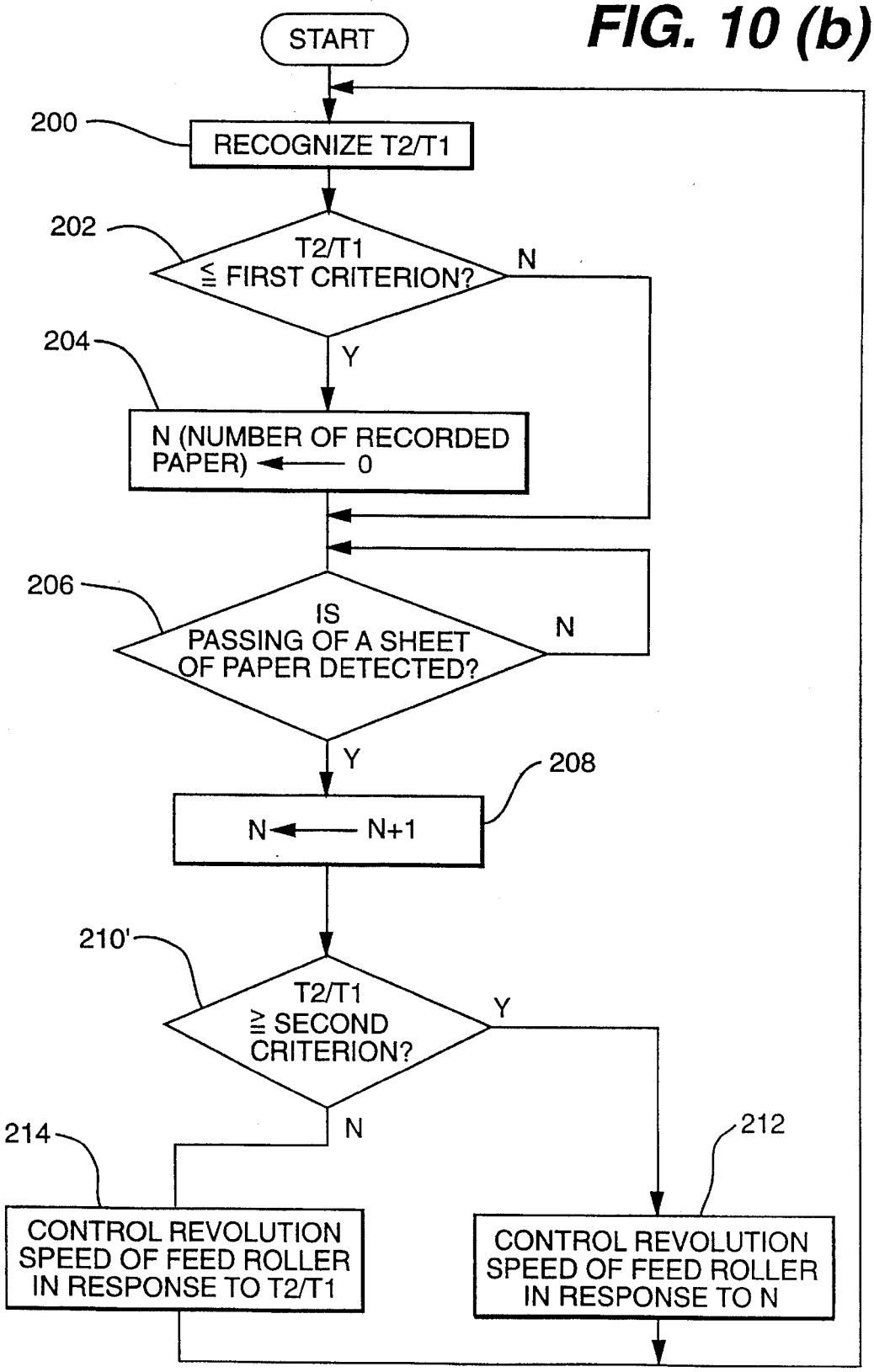

As shown in FIG. 10(*a*), the control circuit 92 receives the signal from the detector 60 indicative of the value of T2/T1 (step 200). After that, the control circuit 92 compares the value of T2/T1 to a first criterion (step 202). If the value of T2/T1 is at or below the first criterion, the control circuit 92 recognizes that the toner hopper 41 is full with toner and sets the value of N corresponding to the number of recorded sheets of paper to "0." (Step 204). If the value of T2/T1 is above the first criterion or after step 204, the control circuit 92 is in a state of waiting to receive the signal from the detector 90. If the detector 90 detects the passage of a sheet of paper (step 206), the control circuit 92 adds a value of "1" to the value of N (step 208). If the value of N is at or below a predetermined number N1 (step 210), the control circuit 92 controls the revolution speed of the feed roller 43 in response to the value of N (step 212). In this state, as the value N decreases, the control circuit 92 decreases the revolution speed of the feed roller 43. If the value of N is above a predetermined number N1, e.g., 50, the control circuit 92 controls the revolution speed of the feed roller 43 in response to the value of T2/T1 (step 214).

Figure 15:
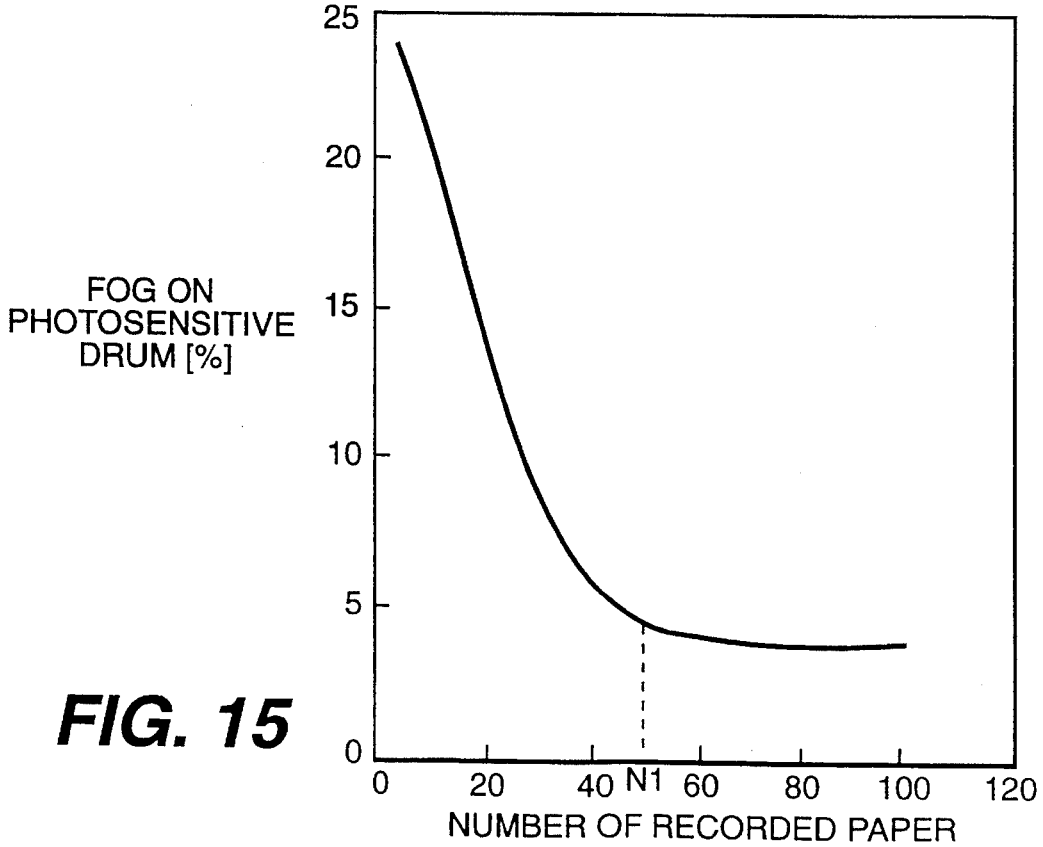
FIG. 15 is a chart illustrating a relationship between the amount of fog on a photosensitive drum and a number of recorded sheets of paper.

The predetermined number N1 is shown in FIG. 15. While the number of recorded sheets of paper N ranges from "1" to "N1", the fog density changes rapidly. During this period, the revolution speed of the feed roller 43 is controlled by the value of N. The control circuit 92 firstly controls the revolution speed of the feed roller 43 in response to the number of recorded sheets during the above period and afterwards controls it in response to the amount of the toner in the toner hopper 41. It is contemplated that the control circuit 92 may control the revolution speed of the feed roller 43 only in response to the number of recorded sheets. It is further contemplated that the control circuit 92 may also control the revolution speed of the agitator 51, the location of the feed roller 43, and the voltage difference between the feed roller 43 and the developing roller 44 in response to the number of recorded sheets.

Alternatively, as shown in FIG. 10(*b*), in step 210', the value T2/T1 may be compared with a second criterion which is preferably less than the first criterion in step 202. In this case, if the value T2/T1 is at or above the second criterion, the control circuit 42 controls the revolution speed of the feed roller 43 in response to the value of N. If the value of T2/T1 is below the second criterion, the control circuit 92 controls the revolution speed of the feed roller 43 in response to the value of T2/T1.

Figure 11:
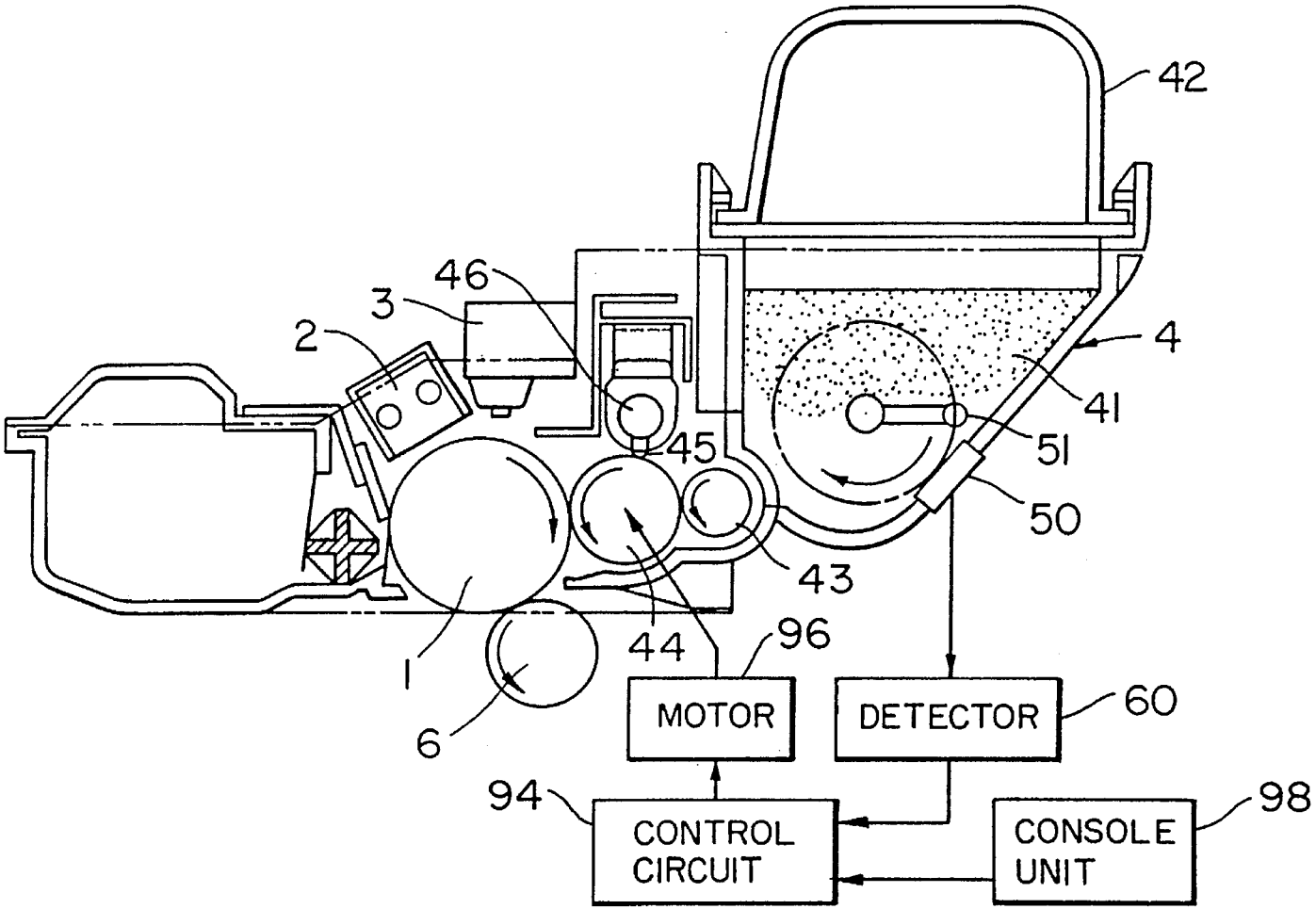
FIG. 11 is a cross-sectional side view illustrating a seventh embodiment of the present invention.

FIG. 11 shows a seventh embodiment. In the seventh embodiment, the revolution speed of the developing roller 44 is controlled in response to the remaining amount of toner in the toner hopper 41. As shown in FIG. 11, a control circuit 94 receives an output signal from the detector 60 indicative of the remaining amount of toner. In response to this signal, the control circuit 94 controls a motor 96 for driving the developing roller 44. As the remaining amount of toner becomes small, the control circuit 94 controls the motor 96 so that the revolution speed of the developing roller 44 increases. The control circuit 94 may also regulate the revolution speed of the developing roller 44 in response to a user's instruction from a console unit 98.

The foregoing descriptions of the preferred embodiments of the invention have been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

We claim:

1. A developing device for use in an image forming apparatus, comprising:

a toner hopper containing toner;

a developing roller for developing an electrostatic latent image formed on a surface of a photosensitive member using the toner contained in the toner hopper;

a toner feed mechanism for conveying the toner contained in the toner hopper to the developing roller, the toner feed mechanism including a feed roller rotating in contact with the developing roller; and regulating means for regulating the conveyance of the toner by the feed mechanism from the toner hopper to the developing roller, said regulating means including a toner detector for detecting amount of the toner contained in the toner hopper and a controller for controlling revolution speed of the feed roller in accordance with the amount of toner detected by the toner detector.

2. The developing device of claim 1, wherein the controller increases the revolution speed of the feed roller as the amount of the toner detected by the toner detector decreases.

3. A developing device for use in an image forming apparatus, comprising:

a toner hopper containing toner;

a developing roller for developing an electrostatic latent image formed on a surface of a photosensitive member using the toner contained in the toner hopper;

a toner feed mechanism for conveying the toner contained in the toner hopper to the developing roller, the toner feed mechanism including a feed roller rotating in contact with the developing roller; and regulating means for regulating the conveyance of the toner by the feed mechanism from the toner hopper to the developing roller, said regulating means including a toner detector for detecting amount of the toner contained in the toner hopper and a controller for controlling position of the feed roller on the developing roller in accordance with the amount of the toner detected by the toner detector.

4. The developing device of claim 3, further comprising a toner friction member, the toner being charged by friction between the developing roller and toner friction member to have a predetermined voltage polarity, and wherein the controller moves the feed roller on the developing roller toward the toner friction member as the amount of the toner detected by the toner detector decreases.

5. A developing device for use in an image forming apparatus, comprising:

a toner hopper containing toner;

a developing roller for developing an electrostatic latent image formed on a surface of a photosensitive member using the toner contained in the toner hopper;

a toner feed mechanism for conveying the toner contained in the toner hopper to the developing roller, the toner feed mechanism including a feed roller rotating in contact with the developing roller; and regulating means for regulating the conveyance of the toner by the feed mechanism from the toner hopper to the developing roller, said regulating means including a toner detector for detecting amount of the toner contained in the toner hopper and a controller for controlling a voltage difference between the feed roller and the developing roller in accordance with the amount of toner detected by the toner detector.

6. The developing device of claim 5, wherein the controller increases the voltage difference as the amount of the toner detected by the toner detector decreases.

7. The developing device of claim 6, wherein the controller increases the voltage difference by increasing only a voltage of the feed roller as the amount of the toner detected by the toner detector decreases.

8. A developing device for use in an image forming apparatus, comprising:

a toner hopper containing toner;

a developing roller for developing an electrostatic latent image formed on a surface of a photosensitive member using the toner contained in the toner hopper;

a toner feed mechanism for conveying the toner contained in the toner hopper to the developing roller; and regulating means for regulating the conveyance of the toner by the feed mechanism from the toner hopper to the developing roller, said regulating means including a counter for counting a number of recorded sheets passing along the surface of the photosensitive member.

9. The developing device of claim 8, wherein the toner feed mechanism includes a feed roller rotating in contact with the developing roller, and the regulating means includes a controller for controlling a revolution speed of the feed roller in accordance with the number of recording sheets counted by the counter.

10. The developing device of claim 8, wherein the toner feed mechanism includes an agitating member rotating in the toner hopper for agitating the toner, and the regulating means includes a controller for controlling a revolution speed of the agitating member in accordance with the number of recorded sheets counted by the counter.

11. The developing device of claim 8, wherein the toner feed mechanism includes a feed roller rotating in contact with the developing roller, and the regulating means includes a controller for controlling a position of the feed roller on the developing roller in accordance with the number of recorded sheets counted by the counter.

12. The developing device of claim 8, wherein the toner feed mechanism includes a feed roller rotating in contact with the developing roller, and the regulating means includes a controller for controlling a voltage difference between the feed roller and the developing roller in accordance with the number of recorded sheets counted by the counter.

13. The developing device of claim 8, further comprising a controller for controlling the conveyance of the toner by the toner feed mechanism from the toner hopper to the developing roller in accordance with the number of recorded sheets counted by the counter if the number of recorded sheets is less than or equal to a criterion, and for controlling the conveyance of the toner by the toner feed mechanism from the toner hopper to the developing roller in accordance with an amount of the toner detected by a toner detector if the number of recorded sheets is greater than the criterion.

14. The developing device of claim 8, further comprising a controller for controlling the conveyance of the toner by the toner feed mechanism from the toner hopper to the developing roller in accordance with the number of recorded sheets counted by the counter if an amount of the toner detected by a toner detector is greater than or equal to a criterion, and for controlling the conveyance of the toner by the toner feed mechanism from the toner hopper to the developing roller in accordance with the amount of the toner detected by a toner detector if the detected amount of the toner is less than the criterion.

15. A developing device for use in an image forming apparatus, comprising:

a toner hopper containing toner;

a developing roller for developing an electrostatic latent image formed on a surface of a photosensitive member using the toner contained in the toner hopper; and regulating means for regulating revolution speed of the developing roller in a single predetermined rotational direction, the regulating means including a toner detector for detecting amount of toner contained in the toner hopper and a controller for controlling the revolution speed of the developing roller in accordance with the amount of toner detected by the toner detector.

16. The developing device of claim 15, wherein the controller increases the revolution speed of the developing roller as the amount of the toner detected by the toner detector decreases.

17. An image forming apparatus comprising:

a photosensitive member;

an exposing member for exposing an electrostatic latent image on a surface of the photosensitive member;

a toner hopper containing toner;

a developing roller for developing the electrostatic latent image formed on the surface of the photosensitive member using the toner contained in the toner hopper;

a toner feed mechanism for conveying the toner contained in the toner hopper to the developing roller, the toner feed mechanism including a feed roller rotating in contact with the developing roller; and regulating means for regulating the conveyance of the toner by the feed mechanism from the toner hopper to the developing roller, said regulating means including a toner detector for detecting amount of the toner contained in the toner hopper and a controller for controlling revolution speed of the feed roller in accordance with the amount of toner detected by the toner detector.

18. An image forming apparatus comprising:

a photosensitive member;

an exposing member for exposing an electrostatic latent image on a surface of the photosensitive member;

a toner hopper containing toner;

a developing roller for developing the electrostatic latent image formed on the surface of the photosensitive member using the toner contained in the toner hopper;

a toner feed mechanism for conveying the toner contained in the toner hopper to the developing roller, the toner feed mechanism including a feed roller rotating in contact with the developing roller; and regulating means for regulating the conveyance of the toner by the feed mechanism from the toner hopper to the developing roller, said regulating means including a toner detector for detecting amount of the toner contained in the toner hopper and a controller for controlling position of the feed roller on the developing roller in accordance with the amount of toner detected by the toner detector.

19. An image forming apparatus comprising:

a photosensitive member;

an exposing member for exposing an electrostatic latent image on a surface of the photosensitive member;

a toner hopper containing toner;

a developing roller for developing the electrostatic latent image formed on the surface of the photosensitive member using the toner contained in the toner hopper;

a toner feed mechanism for conveying the toner contained in the toner hopper to the developing roller, the toner feed mechanism including a feed roller rotating in contact with the developing roller; and regulating means for regulating the conveyance of the toner by the feed mechanism from the toner hopper to the developing roller, said regulating means including a toner detector for detecting amount of the toner contained in the toner hopper and a controller for controlling a voltage difference between the feed roller and the developing roller in accordance with the amount of toner detected by the toner detector.

20. An image forming apparatus comprising:

a photosensitive member;

an exposing member for exposing an electrostatic latent image on a surface of the photosensitive member;

a toner hopper containing toner;

a developing roller for developing the electrostatic latent image formed on the surface of the photosensitive member using the toner contained in the toner hopper; and regulating means for regulating revolution speed of the developing roller in a single predetermined rotational direction, the regulating means including a toner detector for detecting amount of toner contained in the toner hopper and a controller for controlling the revolution speed of the developing roller in accordance with the amount of toner detected by the toner detector.

* * * * *